US006305971B1

(12) United States Patent
Yu-Feng

(10) Patent No.: US 6,305,971 B1
(45) Date of Patent: Oct. 23, 2001

(54) FLAT CABLE INSERTION SOCKET

(76) Inventor: Yen Yu-Feng, 3F, No. 18, Lane 87, Szu Yuan Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/540,182

(22) Filed: Mar. 31, 2000

(30) Foreign Application Priority Data

May 28, 1999 (TW) ..... 88208599

(51) Int. Cl.[7] ..... H01R 12/24
(52) U.S. Cl. ..... 439/493; 439/492
(58) Field of Search ..... 439/493, 67, 77, 439/329, 331, 267, 546, 492, 494, 497, 325, 326, 260, 495, 261

(56) References Cited

U.S. PATENT DOCUMENTS 4,718,859 * 1/1988 Gardner ..... 439/329
6,099,346 * 8/2000 Hashiguchi et al. ..... 439/495

* cited by examiner

*Primary Examiner*—Gary Paumen
*Assistant Examiner*—Ross Gushi
(74) *Attorney, Agent, or Firm*—W. Wayne Liauh

(57) ABSTRACT

A flat cable insertion socket has a pivotally connected cover for closing an open side of the socket and a plurality of internal terminal cavities for each receiving a terminal therein. The terminal each includes a barb portion that is provided at one side with at least two barbs. An additional hook may be optionally provided on the terminal opposite to the barb portion, so that a flat cable may be inserted into the socket to locate and be pressed between the barb portion and the additional hook without the risk of separating from the socket. The barb portions of the terminals in the flat cable insertion socket are so designed that the cover may be always located at an upward turnable position relative to the socket when the socket has been welded to a circuit board, and that the flat cable may always has its bared side effectively and electrically contacted with the terminals.

2 Claims, 6 Drawing Sheets

FLAT CABLE INSERTION SOCKET

BACKGROUND OF THE INVENTION

The present invention relates to a flat cable insertion socket, and more particularly to a flat cable insertion socket having terminals that allows a cover of the socket to be always pivotally upward turnable to facilitate convenient insertion of a flat cable into the socket to firmly contact with the terminals.

It is a common practice to use flat cables on an integrated circuit board for connecting circuits. The flat cables are connected to the circuit board via a plurality of tiny insertion sockets. FIG. 1 is a side sectional view of a conventional insertion socket 12 for such purpose. The insertion socket 12 may be provided with a cover 14. The cover 14 can be lifted to widen an opening of the socket for a flat cable 10 to conveniently insert thereinto. When the cover 14 is closed, it applies a force on the flat cable 10 to press the same against terminals 11 located in the socket 12, so that the flat cable 10 and the terminals are electrically connected. The flat cable 10 has only one bared side for pressing against and electrically contacting with the terminals 11. The other side of the flat cable 10 is insulated. For the bared side of the flat cable 10 to always contact with the terminals, there are times when the socket 12 must be welded to a circuit board 13 upside down, as shown in FIG. 2. However, the cover 14 on the upside-down socket 12 could not be fully opened for the flat cable 10 to insert into the socket 12 easily. The insertion of the flat cable 10 into the upside-down socket 12 is therefore difficult.

The terminals 11 disposed in the socket 12 shown in FIG. 1 each includes only one barb 15 that is the only one point at where the flat cable 10 contacts with each terminal 11. In order to reinforce the contact of the flat cable 10 with the terminals 11, it has been tried to increase a pressure applied by the closed cover 14 on the socket 12. However, due to the fact that a reaction force is equal to the applied force, terminals 11 in the socket 12 generate an increased reaction force on the cover 14 when the latter applies an increased force on the socket 12. In the event the socket 12 has a very small volume, a reaction force applied on the cover 14 might cause a central area of the cover 14 to arch and deform that will have adverse influence on an expected pressure to be applied by the cover 14.

Therefore, the conventional insertion socket 12 shown in FIGS. 1 and 2 has the problem of having a cover 14 that could not be fully opened when the socket 12 is upside-down and might be deformed when the socket 12 is very small. On the other hand, there is no doubt that future circuit boards 13 will become smaller and smaller in the development of integrated circuits and the conventional insertion socket 13 would finally become unacceptable for the very small circuit board 13.

SUMMARY OF THE INVENTION

It is therefore a primary object of the present invention to provide a flat cable insertion socket, in which each terminal is provided with at least two barbs to increase pressing points where an inserted flat cable presses against and contacts with the terminal. The increased barbs on the terminals provide sufficient friction to prevent the inserted flat cable from separating from the insertion socket even if a cover of the socket applies a reduced forward pressure on the inserted flat cable and the terminals.

Another object of the present invention is to provide a flat cable insertion socket, in which each terminal contacts with and presses against either side of an inserted flat cable, so that the insertion socket can be welded to a circuit board always with a cover thereof in an upward turnable position to be opened conveniently.

A further object of the present invention is to provide a flat cable insertion socket, in which each terminal is provided with a barb portion that may face upward or downward to press against an inserted flat cable, depending on the orientation of a bared side of the flat cable in the socket.

A still further object of the present invention is to provide a flat cable insertion socket, in which each terminal has a barb portion on which barbs in increased number are provided to increase contact points between an inserted flat cable and the terminals, so that good electric connection of the flat cable to the terminals is ensured, a circuit impedance is reduced, and reliable electrical performance of the socket can be upgraded.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
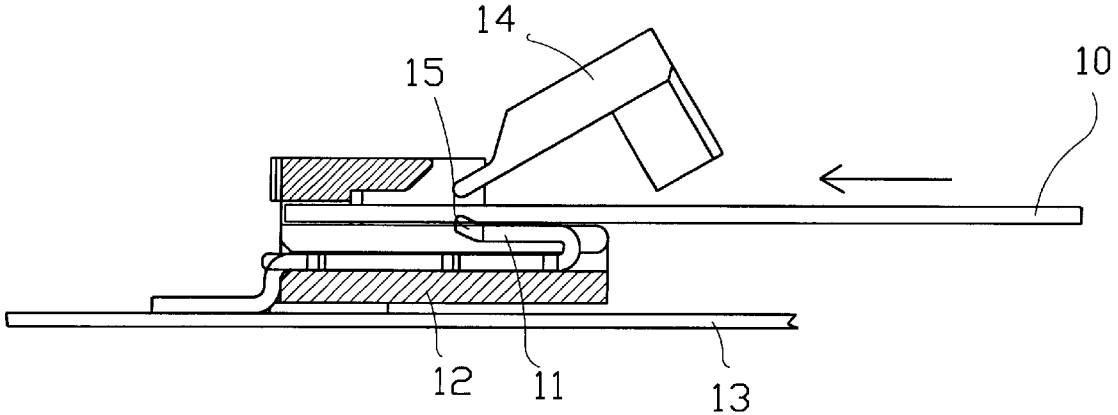
FIG.1 PRIOR ART
FIG. 1 is a side sectional view of a conventional flat cable insertion socket having an upward turnable cover.
Figure 2:
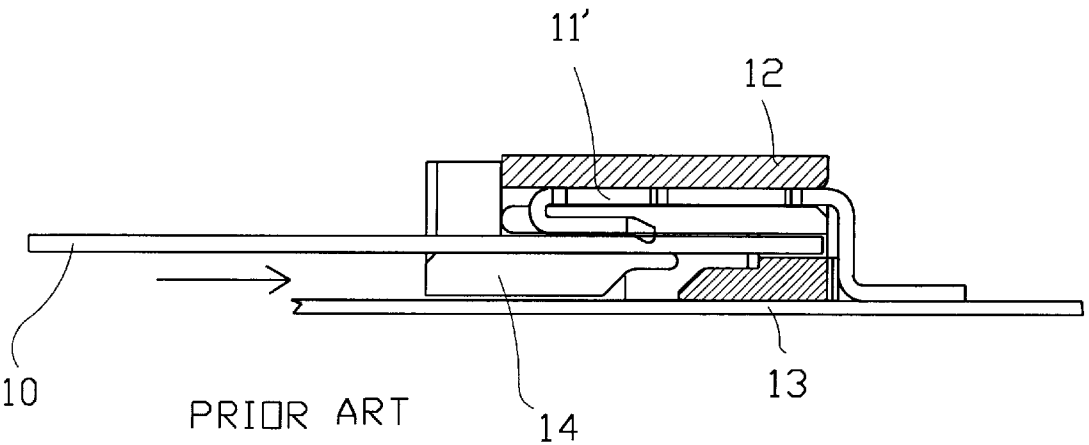
FIG.2 PRIOR ART
FIG. 2 is a side sectional view of the flat cable insertion socket of FIG. 1 in an upside-down position.
Figure 3:
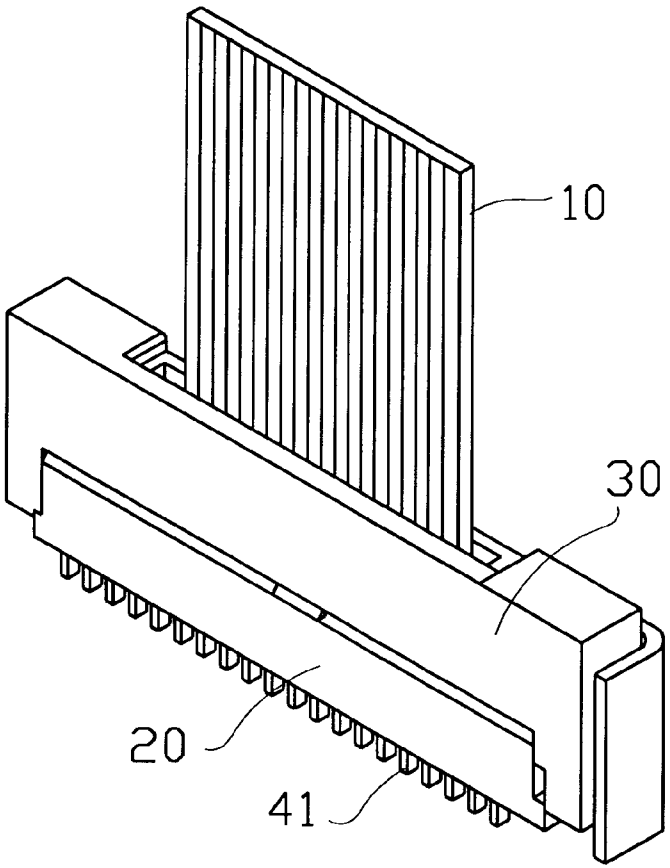
FIG. 3 is a perspective of a flat cable insertion socket according to an embodiment of the present invention.
Figure 4:
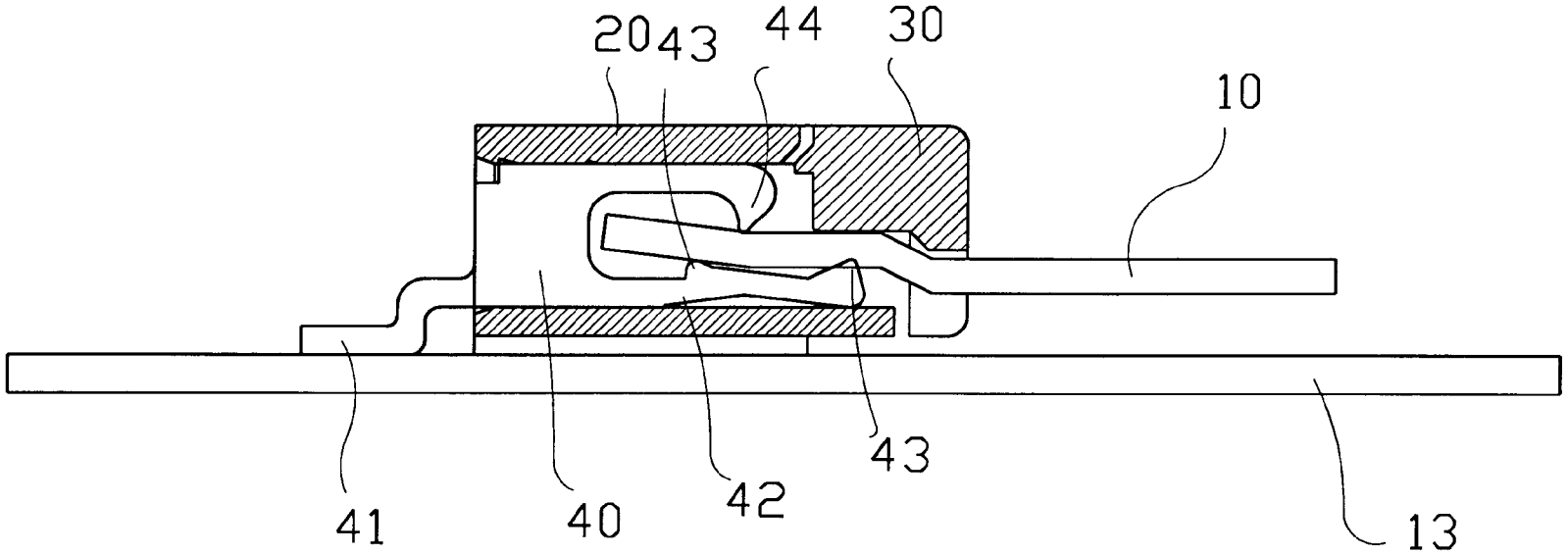
FIG. 4 is a side sectional view of the flat cable insertion socket of FIG. 3 with an upward turnable cover thereof in a closed position.

Please refer to FIGS. 3 and 4 that are perspective and side sectional views, respectively, of a flat cable insertion socket according to an embodiment of the present invention. As shown, the flat cable insertion socket generally includes a main body 20 defining a plurality of terminal cavities 21 therein, a cover 30 pivotally connected to one open side of the main body 20, and a plurality of terminals 40 separately mounted in the terminal cavities 21 in the main body 20. The terminal 40 is located in the cavity 21 such that a pin portion 41 thereof projects from another side of the main body 20 opposite to the cover 30 and a barb portion 42 thereof is completely located in the terminal cavity 21. Please refer to FIG. 5, the cover 30 is provided at two lateral ends with two pivotal pins 31, so that the cover 30 is pivotally connected to the main body 20 and could be upward turned about the pivotal pins 31. When the cover 30 is in an upward opened position, a flat cable 10 may be inserted into the main body 20 via the open side thereof. After the flat cable 10 has been fully inserted into the main body 20 of the insertion socket, the cover 30 is downward turned to close the main body 20. At this point, the cover 30 would apply a downward force on the flat cable 10 and cause the latter to press against the barb portions 42 of the terminals 40. The barb portion 42 each is provided at predetermined positions with at least two upward barbs 43. A downward hook 44 may be additionally provided on each terminal 40 at a predetermined position opposite to the barb portion 42, so that the inserted flat cable 10 is located in a space between the barb portion 42 and the downward hook 44. In this manner, the barb portion 42 and the downward hook 44 together provide at least three points to contact with and press against the inserted flat cable 10, ensuring that the flat cable 10 is firmly clamped between the barbs 43 and the hook 44 with a bared side of the flat cable 10 electrically connected to the terminals 40.

It is preferable that two or three upward barbs 43 are provided on the barb portion 42 of each terminal 40. In the case two upward barbs 43 and one downward hook 44 are provided, three contact points on each terminal 40 are formed to press against the inserted flat cable 10 when the cover 30 is pivotally turned downward to close the main body 20 of the insertion socket. A total pressure applied on the flat cable 10 by the terminals 40 is a sum of the pressures applied on the flat cable 10 by the upward barbs 43 and the downward hook 44. As to the pressures applied on the flat cable 10 by the barbs 43 and the hook 44, they are generated due to a pressure applied on the barb portions 42 and the flat cable 10 when the cover 30 is closed onto the main body 20. By increasing the number of press points on the barb portions 42 and the terminals 40, the pressure applied by the barbs 43 and the hooks 44 on the flat cable 10 for firmly holding the latter in place may be increased while a forward pressure applied by the cover 30 on the flat cable 10 and/or the barb portions 42 may be relatively reduced. A cover 30 with reduced forward pressure also reduces a reaction force generated by the flat cable 10 and the barb portions 42 when the cover 30 is downward closed onto the main body 20. The problem of an upward arched cover 30 at the closed position can therefore be avoided. Since the upward barbs 43 on the barb portions 42 and the downward hooks 44 on the terminals 40 separately press against two sides of the flat cable 10, a good electrical connection of the flat cable 10 to the terminals 40 is ensured. Meanwhile, the main body 20 of the insertion socket of the present invention is welded onto a circuit board 13 with the cover 30 always in an upward turnable position to facilitate convenient opening of the cover 30 and easy insertion of the flat cable 10 into the insertion socket. By increasing the number of the upward barbs 43 on the barb portions 42, contact points between the flat cable 10 and the terminals 40 are increased, too. With the increased contact points between the flat cable 10 and the terminals 40, poor electrical connection of the flat cable 10 to the terminals 40 could be avoided and circuit impedance could be reduced to enhance the performance and reliability of the insertion socket and accordingly electric appliances using the flat cable insertion socket of the present invention.

Figure 6:
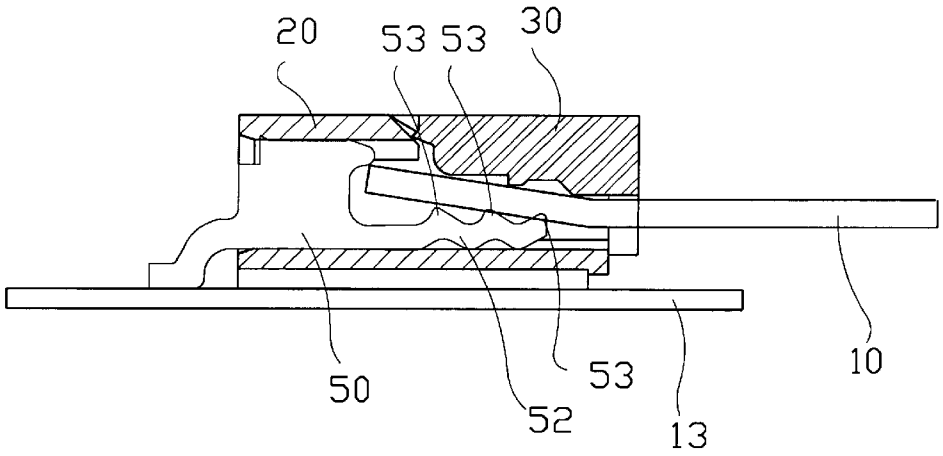
FIG. 6 is a side sectional view of a flat cable insertion socket according to a second embodiment of the present invention.

It is possible that the main body 20 of the insertion socket has a reduced overall thickness and therefore defines terminal cavities 21 that each provides a space dimensioned for receiving only the barb portion 42 of the terminal 40 and the flat cable 10. In this case, the downward hook 44 is omitted. FIG. 6 illustrates a flat cable insertion socket of this type. In this embodiment, terminals 50 each having a barb portion 52 preferably provided with three upward barbs 53 are adopted. In this case, the flat cable 10 is inserted into the main body 20 to locate above the barb portion 52 with the bared side of the flat cable 10 contacting with the upward barbs 53.

Figure 7:
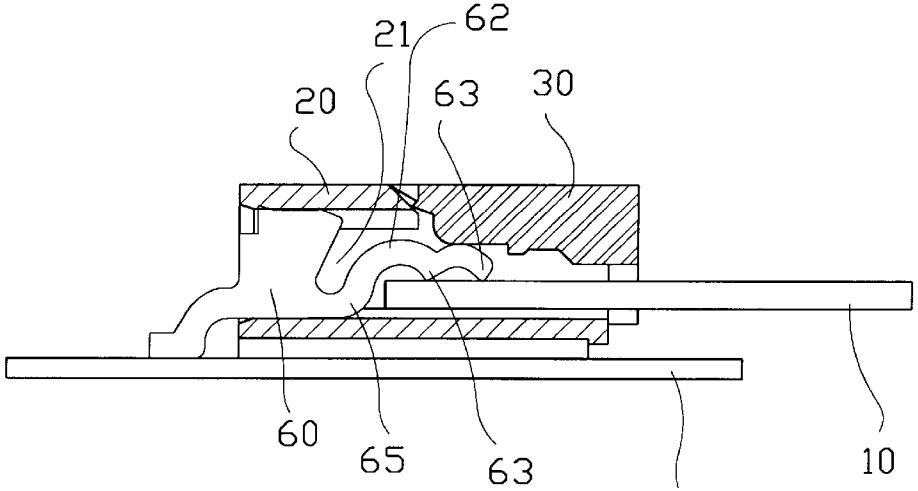
FIG. 7 is a side sectional view of a flat cable insertion socket according to a third embodiment of the present invention.

FIG. 7 illustrates a variant of the flat cable insertion socket of FIG. 6. In the embodiment shown in FIG. 7, the terminal 60 each has an elastic bent portion 65 from which a barb portion 62 extends upward in the terminal cavity 21 to locate close to the cover 30. The barb portion 62 is provided at a lower surface with downward extended barbs 63. In this case, the flat cable 10 is inserted into the main body 20 of the insertion socket to locate below the barb portion 62 with the bared side of the flat cable 10 facing toward the downward extended barbs 63, so that the cover 30 could still be conveniently upward turned open relative to the circuit board 13 to facilitate the insertion of the flat cable 10 into the main body 20.

In the case of FIG. 6, an inner upper surface of the cover 30 contacts with the flat cable 10 to apply a pressure on the latter. And, in the case of FIG. 7, the inner upper surface of the flat cable 10 contacts with and applies a pressure against an upper surfaces of the barb portions 62 that are connected to their respective terminals 60 via the elastic bent portions 65.

Figure 5:
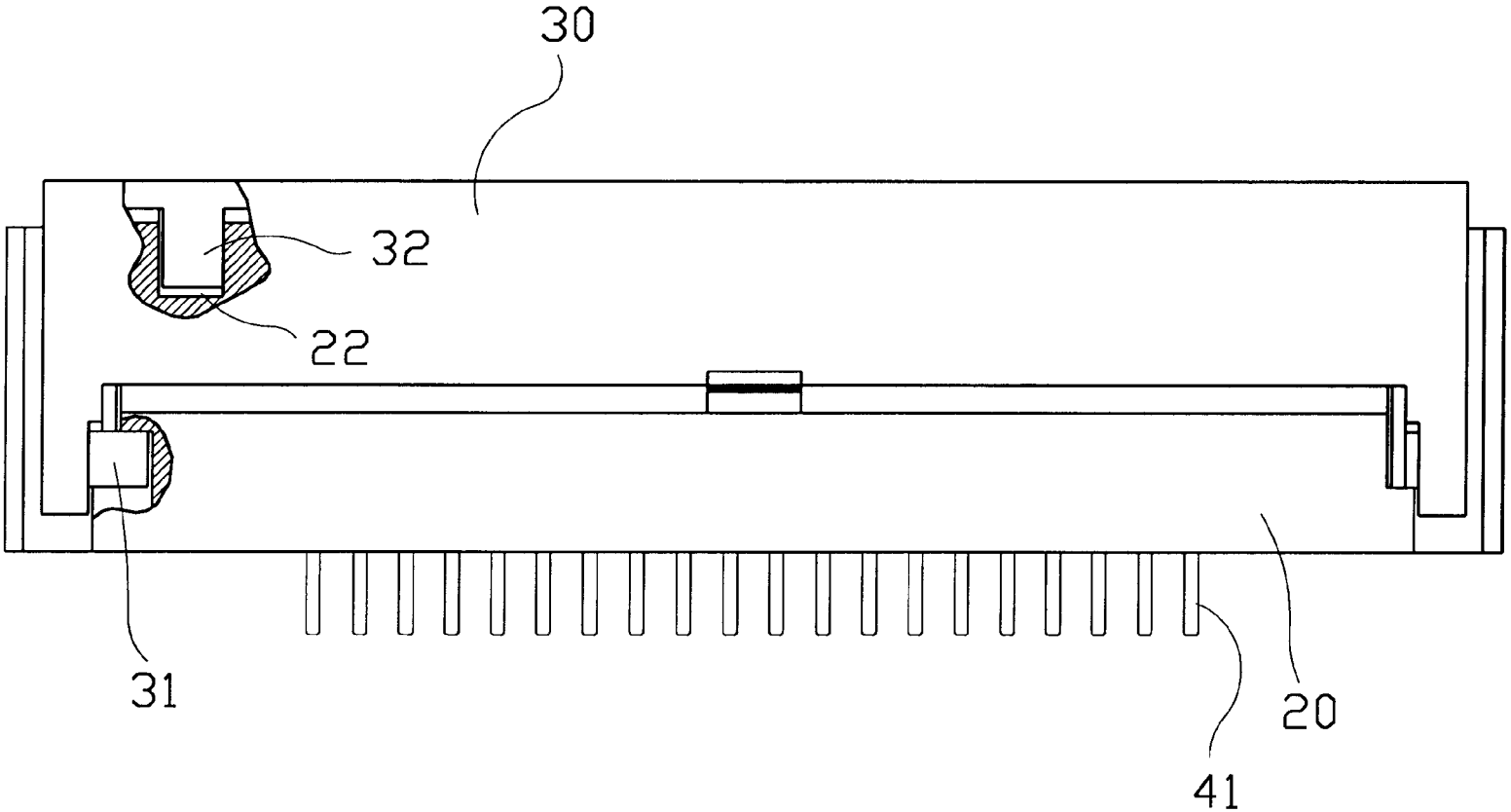
FIG. 5 is a front view of the flat cable insertion socket of FIG. 3 with a part thereof cut away to show an internal structure of the cover.
Figure 9:
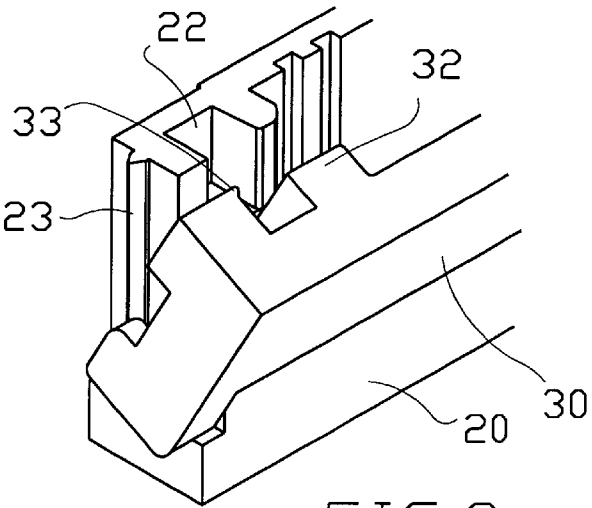
FIG. 9 is a fragmentary and enlarged perspective view of the present invention with the cover in an opened position to show the locking and locating means on the socket.

Please now refer to FIGS. 5 and 9. The cover 30 is provided at an inner front near two lateral ends with two projected locking ribs 32. And, the main body 20 of the flat cable insertion socket is correspondingly provided at an inner front near two lateral ends with two locking channels 22 for receiving the two locking ribs 32 therein when the cover 30 is closed onto the main body 20. When the two locking pins 32 are located in the two locking channels 22, two lateral ends of the cover 30 are subject to two outward pulls that prevents a central portion of the cover 30 from upward arching when the cover 30 is closed onto the main body 20 and the central portion of the cover 30 applies a forward pressure on the flat cable 10 and the barb portions 42, 52, 62.

Figure 8:
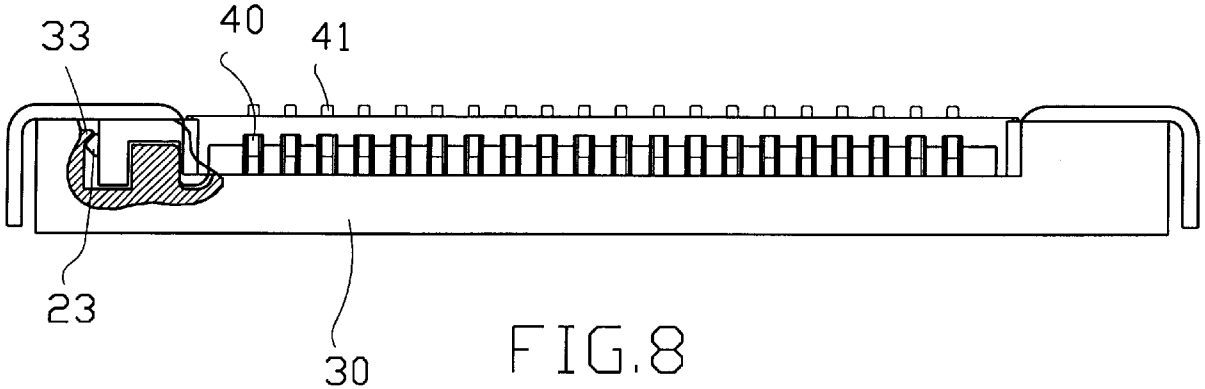
FIG. 8 is a top view of the flat cable insertion socket of the present invention with a part thereof cut away to show the internal structure of the cover.

Please refer to FIGS. 8 and 9. The cover 30 is further with two end ribs 50, respectively positioned just outside of the outer sidewalls 51 of the locking channels 22 when the locking rib 32 is received in the locking channel 22. Each of the end rib 50 is provided at the end of its inner sidewall 53 a retaining rib 33. The locking rib contains a catching rib 23 formed on an outside surface 54 of an outer sidewall 51 of the locking channel 22. The catching rib 23 and the retaining rib 33 are structured such that the retaining rib 33 reversibly passes the catching rib 23 to form a locked position when the locking rib 32 is received in the locking channel 22.

In any of the above embodiments of the present invention, the flat cable insertion socket may be always welded to the circuit board 13 with the cover 30 at an upward turnable position to facilitate insertion of the flat cable 10 into the main body 20. Moreover, all these embodiments enable the cover 30 to close onto the main body 20 without subjecting the cover 30 to a large reaction force from the flat cable 10 and the barb portions. Therefore, the cover 30 may always have a flat top surface and the flat cable insertion socket is more reliable for use.

What is claimed is:

1. A flat cable inserting socket, comprising:

a main body defining a plurality of terminal cavities therein, a plurality of terminals separately located in said a plurality of terminal cavities, and a cover pivotally connected at two pivotal pins provided at two lateral ends to an open side of said main body;

each of said terminals including a barb portion completely received in on corresponding terminal cavity and a pin projected from on side of said main body opposite to said open side with said cover;

a flat cable being inserted into said main body via said open side, such that when said cover is pivotally turned to close onto said main body, said flat cable is pressed by said cover to contact with said barb portions of said terminals;

said flat cable insertion socket being characterized in that each of said terminals is provided on said barb portion at predetermined positions with at least two barbs, and at a position opposite to said barb portion with a hook-like projection, such that said flat cable may be inserted into said main body and held in a space between said barbs and said hook-like projections;

wherein said cover is provided near each of its two lateral inner ends with a locking rib, and said main body of said insertion socket is provided near each of its two lateral ends with a matching locking channel, such that when said cover is closed onto said main body, said locking rib is received in said locking channel;

said locking rib contains a catching rib formed on an outside surface of an outer sidewall of said locking channel, said cover contains an end rib to be positioned just outside of said outer sidewall of said locking channel when said locking rib is received in said locking channel, and said end rib contains a retaining rib formed on an inner sidewall of said end rib; and said catching rib and said retaining rib are structured such that said locking rib reversibly passes said catching rib to form a locked position when said locking rib is received in said locking channel.

2. A flat cable inserting socket, comprising;

a main body defining a plurality of terminal cavities therein, a plurality of terminals separately located in said a plurality of terminal cavities, and a cover pivotally connected at two pivotal pins provided at two lateral ends to an open side of said main body;

each of said terminals including a barb portion completely received in on corresponding terminal cavity and a pin projected from on side of said main body opposite to said open side with said cover;

a flat cable being inserted into said main body via said open side, such that when said cover is pivotally turned to close onto said main body, said flat cable is pressed by said cover to contact with said barb portions of said terminals;

wherein said cover is provided near each of its two lateral inner ends with a locking rib, and said main body of said insertion socket is provided near each of its two lateral ends with a matching locking channel, such that when said cover is closed onto said main body, said locking rib is received in said locking channel;

said locking rib contains a catching rib formed on an outside surface of an outer sidewall of said locking channel, said cover contains an end rib to be positioned just outside of said outer sidewall of said locking channel when said locking rib is received in said locking channel, and said end rib contains a retaining rib formed on an inner sidewall of said end rib; and said catching rib and said retaining rib are structured such that said retaining rib reversibly passes said catching rib to form a locked position when said locking rib is received in said locking channel.

* * * * *